US006134715A

United States Patent [19]

McLennan

[11] Patent Number: 6,134,715

[45] Date of Patent: Oct. 24, 2000

[54] MEDICAL PATIENT GOWN

[76] Inventor: L. Jane McLennan, 1368 E. Harrison Ave., Salt Lake City, Utah 84105

[21] Appl. No.: 09/507,911

[22] Filed: Feb. 22, 2000

[51] Int. Cl.[7] ..... A41D 13/12

[52] U.S. Cl. ..... 2/114; 2/105

[58] Field of Search ..... 2/114, 51, 104, 2/105, 106, 85, 111, 70, 74, 115

[56] References Cited

U.S. PATENT DOCUMENTS

| | | | |
|---|---|---|---|
| 3,824,625 | 7/1974 | Green | 2/114 |
| 3,977,025 | 8/1976 | Horan | 2/51 |
| 4,215,434 | 8/1980 | Barron | 2/114 |
| 4,524,463 | 6/1985 | Ogden | 2/114 |
| 4,578,825 | 4/1986 | Vote | 2/114 |
| 5,005,217 | 4/1991 | Bern et al. | 2/104 |
| 5,050,243 | 9/1991 | Udell | 2/114 |
| 5,062,159 | 11/1991 | Jakub | 2/105 |
| 6,006,356 | 12/1999 | Song | 2/114 |

*Primary Examiner*—Amy B. Vanatta
*Attorney, Agent, or Firm*—M. Reid Russell

[57] ABSTRACT

A medical patient gown formed from a single section of a soft fabric material that is suitable for patient wear in a doctor's office or hospital to cover over a patient's body and is selected to have a pleasing pattern and/or print to be aesthetically pleasing to the patient wearing the garment. The gown can be worn forward or backward, includes wide sleeves, is of a size to be wrapped around the patient's body and closed, and includes easily and conveniently releasable fasteners to secure the wrap around the patient's body that are easily opened to allow access by medical personnel performing a procedure on a section of the patient's body.

9 Claims, 5 Drawing Sheets

MEDICAL PATIENT GOWN

BACKGROUND OF THE INVENTION

1. Field of the Invention

The present invention relates gowns and like coverings for use by a medical patient in a doctor's office or hospital setting as a patient covering that is easily opened to provide access to a medical person.

2. Prior Art

Currently patient gowns as are given to a patient to wear during a medical exam or in a hospital have essentially ignored the considerations of a patient's modesty and its ease of donning in favor of ease of access to the patient's body. Where, heretofore, a patient's mental state and comfort in the wear of present patient gowns has been sacrificed, the invention both provides a garment that a patient is comfortable in, provides both warmth and a secure covering of the patient's body, is a garment that is easily put on and taken off, with the patient needing no assistance to "get it on right" and still provides a convenience of opening to medical personnel conducting an exam or medical procedure on the patient's body. Further, where earlier gowns have ignored gown appearance, the invention lends itself to manufacture from a variety of fabrics, patterns and prints, to provide a patient with a gown that has an attractive and pleasing appearance so as to maintain and even improve the patient's spirits and sense of well-being, while providing a garment that is both functional and cost-effective to produce.

Unlike the invention, earlier patient gowns have generally included ties that extend at spaced intervals from opposite edges of the gown material and has arm holes or sleeves formed there to receive a patient's arms fitted therethrough, allowing the garment to be worn backward or forward with the material to be pulled together and the ties tied together, in bows. Such tie coupling, of course, only pulls the fabric material opposite edges together and, with the ties spaced apart, an open gap is often left between which material edges, wherethrough the patient's body can be seen. The patient, to cover their body, must therefore hold the material edges together to close that inevitable gap or opening, making the experience of wearing the gown potentially very embarrassing. Where the justification for having a gown that cannot be fully closed to effectively cover the patient's body has been a medical need for ready access to such patient's body, in the present invention, this need for ready access is met without a sacrifice in patent modesty.

SUMMARY OF THE INVENTION

It is a principal object of the present invention in an improved medical patent gown to provide a gown that is formed from a section of soft flexible cloth material of a size to conveniently wrap around a patient's body and that can be secured and maintained in such wrapped attitude by a plurality of conveniently located fasteners.

Another object of the present invention in an improved medical patient's gown is to provide a gown that is arranged to be wrapped comfortably around a patent, that can be donned by the patient by their fitting their arms through arm holes as have been formed in the gown, where, the gown material is stretched across their chest when worn backwards, the one gown edge is pulled across their back over the opposite gown edge and releasably connected to the gown material along the gown side, or where the gown is worn forward, the gown is put on as a person puts on a coat or shirt, the one gown edge pulled across the other gown edge and is releasably secured to the gown surface along the gown side.

Another object of the present invention in an improved medical patient's gown is to provide a gown having a neck area that is contoured to allow for a comfortable wearing of the gown whether it is worn backwards or forwards.

Still another object of the present invention in an improved medical patient's gown is to provide a gown that, when closed around a patent, can still be conveniently opened by medical personnel to allow access to their chest or back, and can be opened along the length of that patient's arms and down their sides, and which openings can then be easily and quickly closed back to a covering attitude when the medical procedure is completed.

Still another object of the present invention in an improved medical patient's gown is to provide a gown that is easily manufactured, is aesthetically pleasing, is practical to conveniently don and remove and will maintain its covering attitude during patient movement without a necessity for the patient holding the gown edges together, or the like, comfortably maintaining the wearer patient's dignity.

The present invention is in an improved medical patient's gown formed from a section of a fabric material as is suitable for wear by a patient to cover their naked body in a setting of a doctor's office, hospital, or the like. The selected material is preferably a soft flexible fabric material having a pleasing appearance, such as with a pattern or print presenting an eye pleasing appearance, and is sufficiently large to be conveniently wrapped around the patient's body. The gown has arm openings or sleeves and a neck cut into the gown back area to allow the patient to conveniently don the gown as by fitting it in either a forward or backward attitude, with their arms passed through the arm holes or sleeves and with the gown material fitted across their back or chest. The one gown edge is then wrapped across their chest or back, crossing the other gown edge, covering their body, and the one gown edge is then pulled across the other edge and connected to the gown side. The gown further includes a fastener for closing the gown edges below the patient's neck that can be easily opened. So arranged, the wrap edges can be conveniently pulled out to give a medical person access to the patients chest as determined by the procedure the patient is to receive and can then be refastened, providing gown closure.

As set out above, the material of the gown is selected to be of a sufficient size to conveniently wrap around the patient, covering their body, with the one edge or edge area below a collar area to pass over the other gown edge and to couple onto the gown material surface. Which coupling is preferably a Velcro type coupling consisting of hook and mat sections that connect when pressed together, but may be snaps, buttons, ties, or the like, within the scope of this disclosure. Further, for providing a versatile garment, the gown of the invention may be slit up the side and sleeves with opposing closures, such as Velcro type fasteners, secured, in opposition to one another, along the edges of which slits for allowing the individual slits to be conveniently opened so as to provide access to the patient's arms, legs and sides, for performing a medical procedure thereon. Which slit edge can thereby be conveniently closed, covering these area, after the procedure is completed. With the gown of the invention, the patient at all times can be modestly covered, affording the patient a sense of well being that their body private parts will not be inadvertently exposed.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
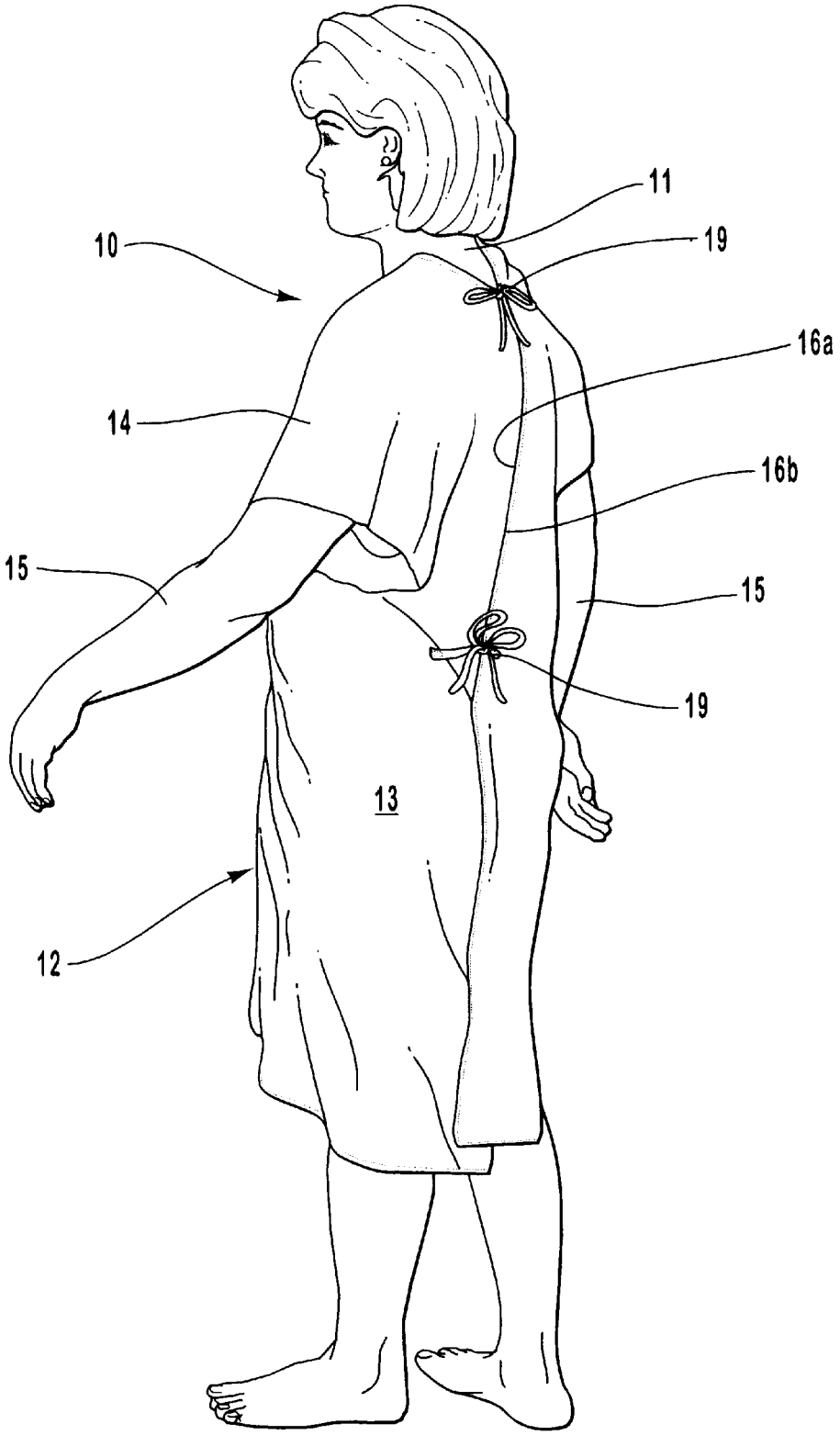
FIG. 1 (PRIOR ART)
FIG. 1 is identified as Prior Art and shows a rear and side elevation perspective view of a patient wearing a gown that they have donned by fitting their arms through the sleeves and with the gown edges closed together by tying ties together that are spaced at intervals along their back, potentially leaving a crack or opening between the abutting gown edges, which gown is currently commonly in use in doctor's offices, hospitals, and the like, and which gown the invention improves upon.
Figure 2:
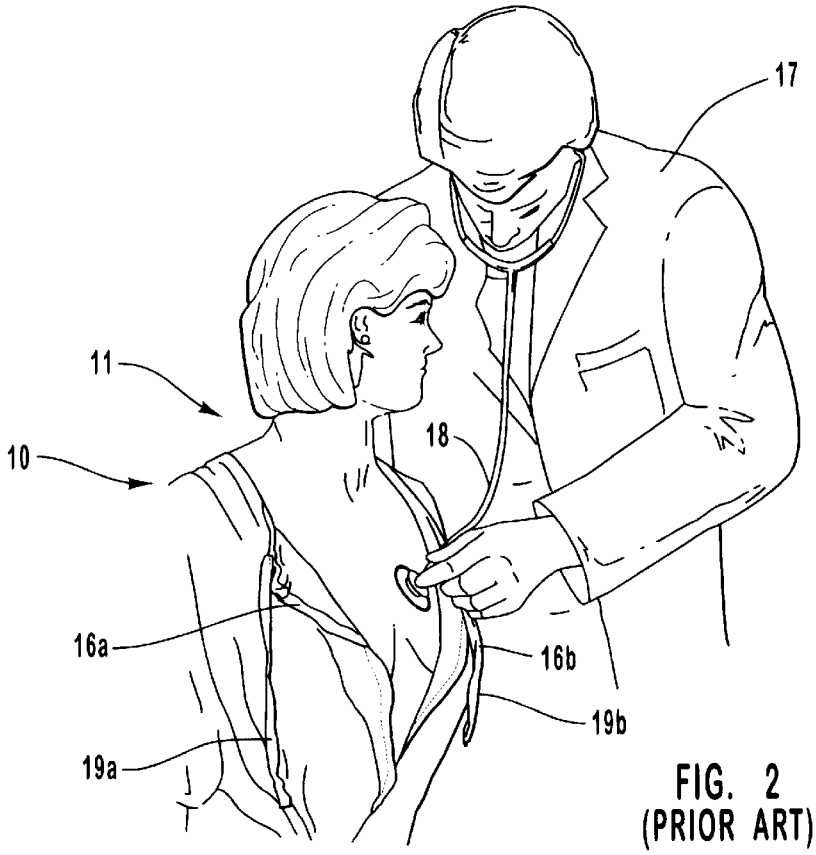
FIG. 2 (PRIOR ART)
FIG. 2 is identified as Prior Art and is a view of a patient wearing a gown of FIG. 1 that they have put on by fitting their arms through the sleeves and tying the gown edges together down their front, with a top tie shown unconnected, allowing the tops of the gown edges to fall apart and showing a doctor listening with a stethoscope to the patient's heart or lungs.
Figure 3:
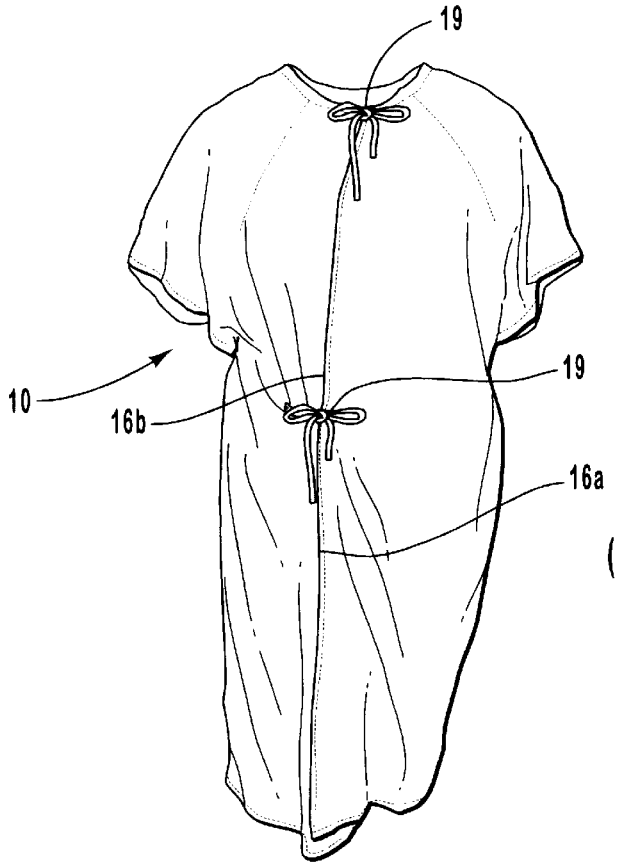
FIG. 3 (PRIOR ART)
FIG. 3 is identified as Prior Art and is a rear elevation view of the gown of FIG. 1.

FIG. 1 is identified as Prior Art and is herein included to shown what is believed to be the current state of the art in medical patient 10 gowns. Shown therein, such earlier patient gowns 12, like the invention, have generally been formed from a single section of material, preferably a cloth type material 13, that is sized and is formed to extend to cover from a patient's neck 11 to around their knees, has sleeves 14 formed therein for receiving the patient's arms 15, with the opposing gown 10 edges 16*a* and 16*b* shown closed together by tying together ties 19*a* and 19*b*. In practice, the gown 10, like the invention, can be worn, as shown in FIG. 1, with the arms fitted through sleeves and the edges 16*a* and 16*b*, jointed along the patient's back. Or the gown 10 can be worn, as shown in FIGS. 2 and 3. With, in FIG. 2, the gown 10 is shown as having been partially opened down its front by releasing or untying top ties 19*a* and 19*b*, allowing a medical person 17 to listen to the patient's heart or lungs with their stethoscope 18.

The prior art gown 10 can be worn as shown in FIGS. 1 and 3, or as shown in FIG. 2, and is closed along opposing edges 16*a* and 16*b* by tying ties 19*a* and 19*b* together, as by forming a bow 19 with opposing ties, as shown in FIGS. 1 and 3. So arranged, while the gown edges 16*a* and 16*b* are held together there will often remain a gap between which edges, allowing a portion of the patient's body to be exposed. In practice, where the gown is worn as show in FIGS. 1 and 3, the patient will have to tie the ties 19*a* and 19*b* together into bows 19 along their back, without their being able to see what they are doing, often resulting in a loose coupling or bow, leaving a wide gap between the gown edges 16*a* and 16*b*. Which opening along their back is very difficult for a patient to hold together. Further, with the gown 10 worn as shown in FIGS. 1 and 3, it is often difficult for the patient to know whether or not the ties 19*a* and 19*b* are tied together properly potentially resulting in an unwanted gown opening.

Clearly, it is difficult for a patient, wearing gown 10, to keep themselves well covered with this condition often resulting in patient embarrassment. Further, such gowns do not adequately cover so as to keep the patient warm, resulting in a lowering of their body temperature that may be particularly dangerous to a patient who is already sick.

Figure 4:
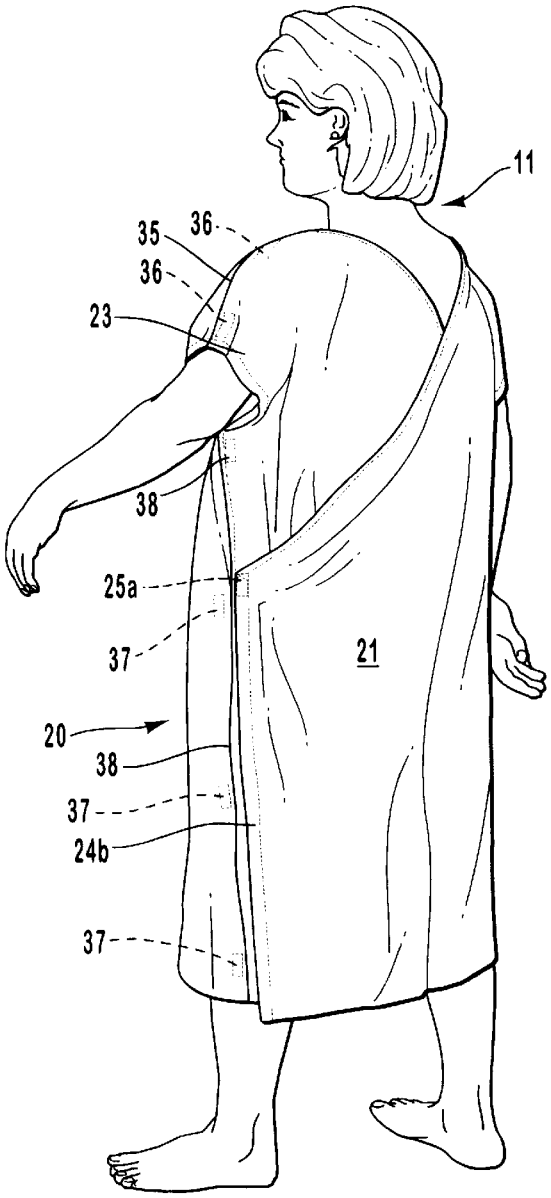
FIG. 4 is a rear and side elevation perspective view of a patient shown wearing the improved medical patient gown of the invention that is wrapped across their back and with one gown edge shown maintained along a gown side.
Figure 5:
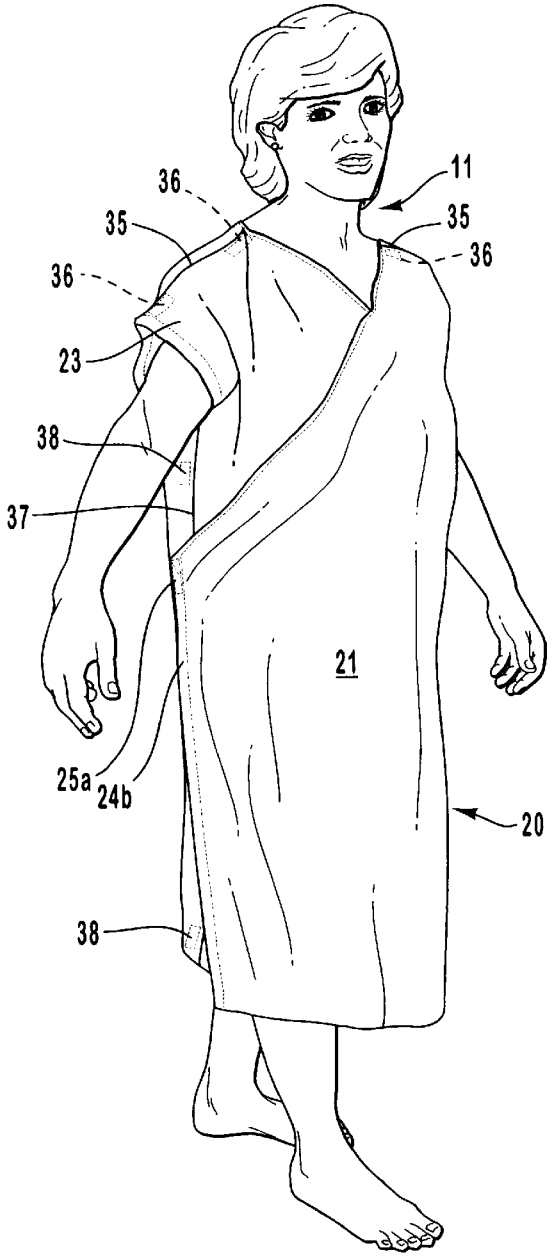
FIG. 5 is a front elevation perspective view of a patient shown wearing the gown of the invention wrapped across their front with the one gown edge maintained along a gown side.
Figure 6:
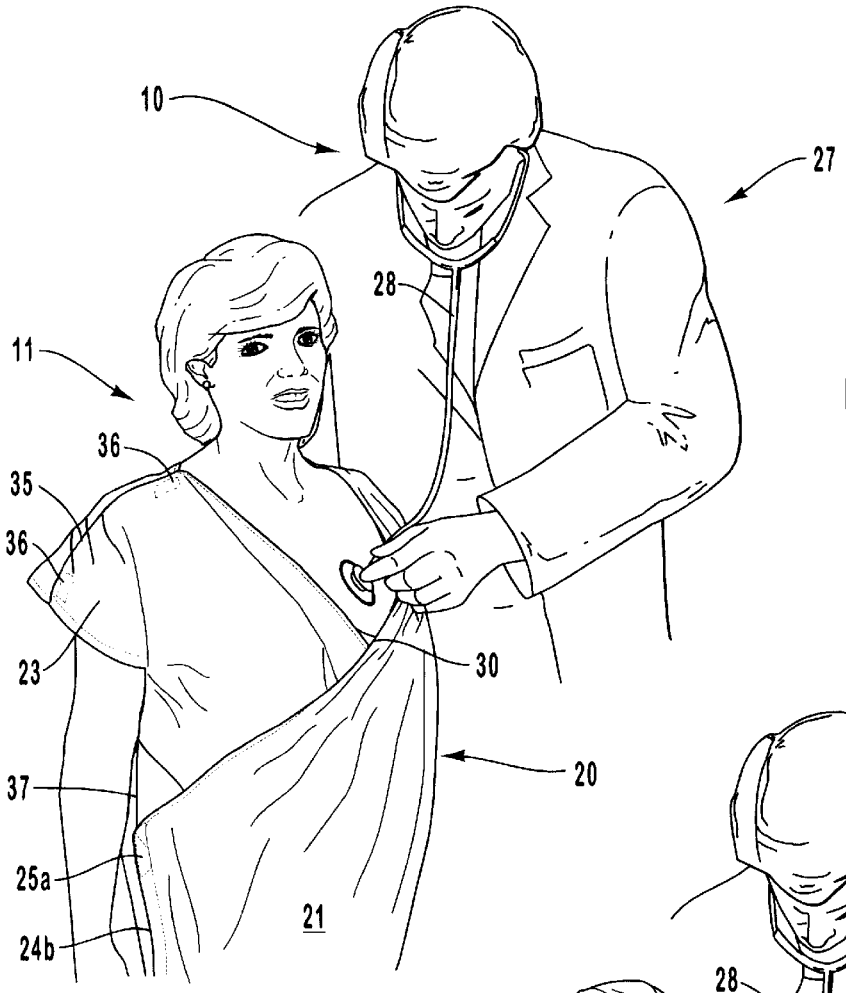
FIG. 6 is a view of the patient and gown of FIG. 5, showing a portion of the gown material at a neck area, and with the gown edge of FIG. 5 shown as having been positioned over, and pulled out to release a neck area gown fastener so as to allow a doctor convenient access to their upper chest area for positioning a stethoscope thereon to listen to their heart or lungs.
Figure 7:
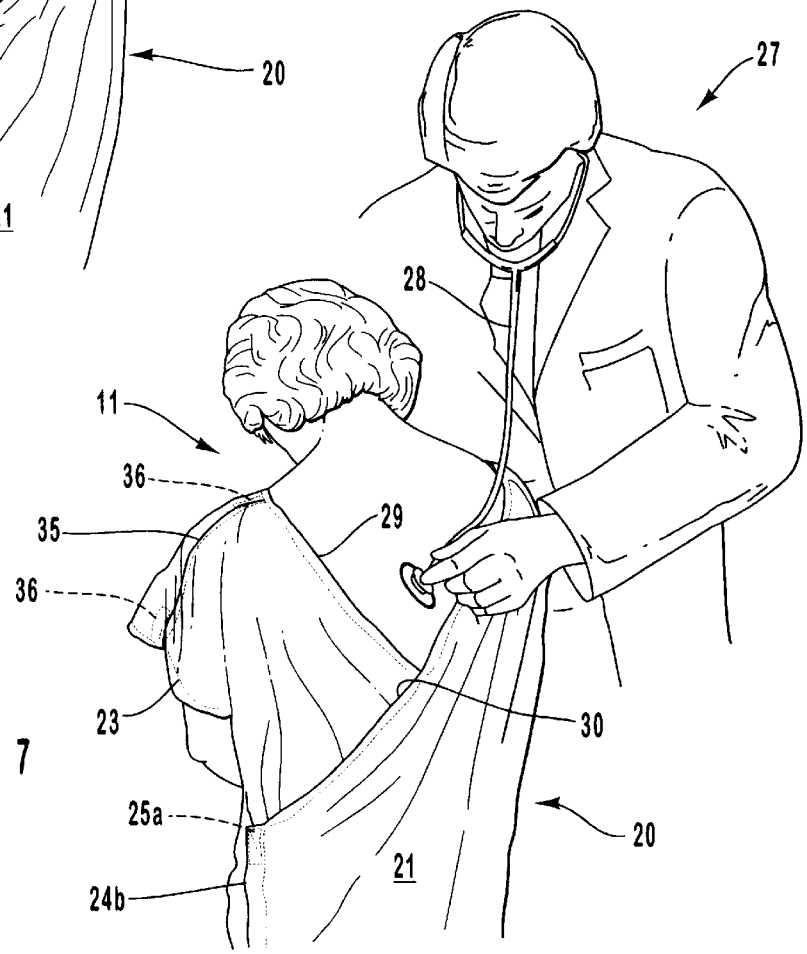
FIG. 7 is a back view of the patient of FIG. 4 that, like the view of FIG. 5, shows the portion of the gown material below their neck area as having been pulled out to allow a doctor convenient access to their upper back area for positioning a stethoscope thereon to listen to the patient's heart or lungs.
Figure 8:
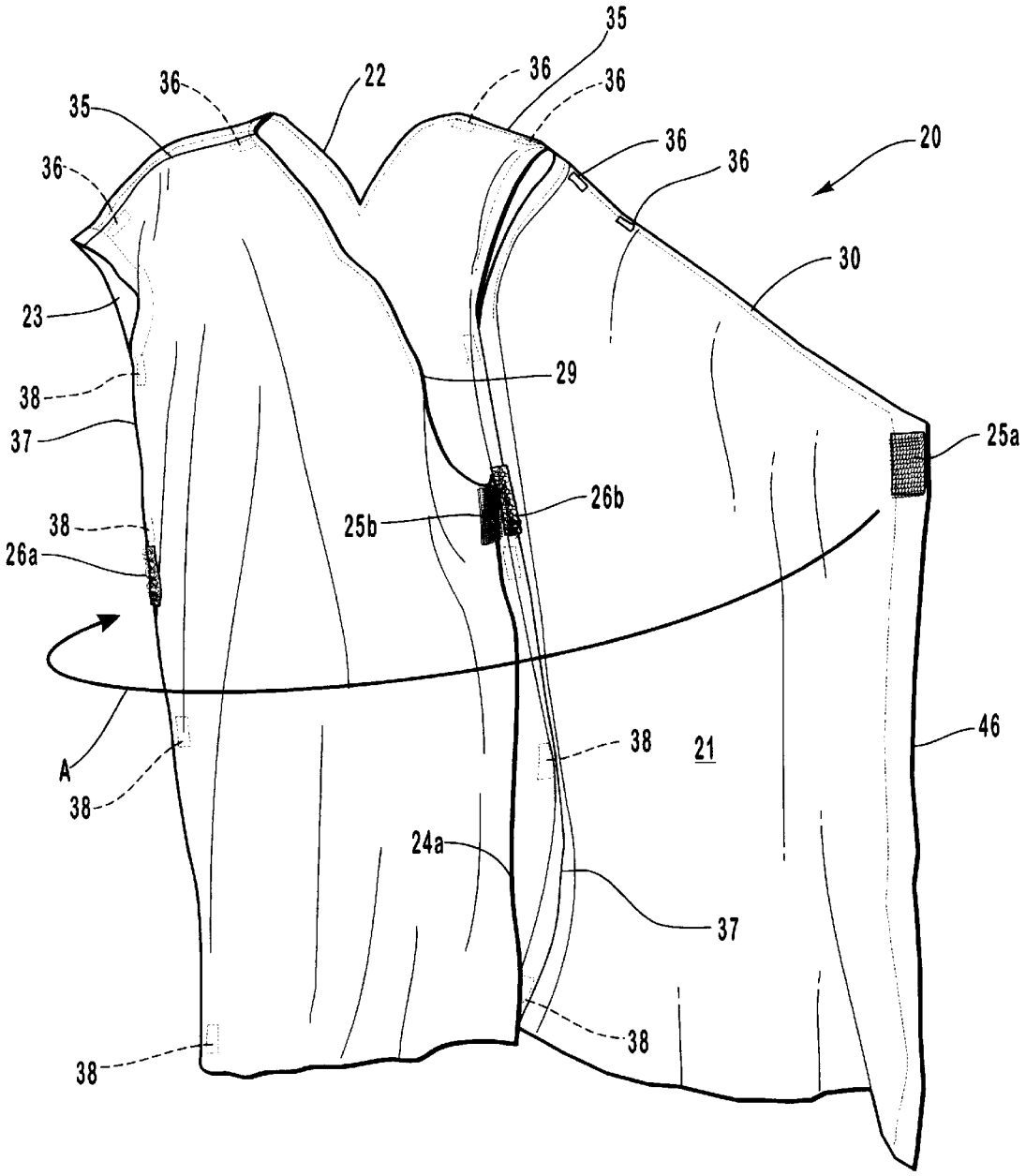
FIG. 8 is a front elevation view of the gown of the invention shown open along its front edges and showing Velcro type fastening stripes secured at appropriate points along the gown edges and at points on the material surface to align and fasten to one another when the gown is wrapped, as shown by arrow A, with the one gown edge passing over the other gown edge, and with the one gown edge connected onto the gown surface.

The invention, as shown in FIGS. 4 through 8, in a gown 20 solves and corrects the above set out defects and deficiencies of earlier gowns in that it is formed from a larger section of material 21 to be wrapped and fastened around patient 11. The gown 20 is to be conveniently worn with the patient's neck aligned with a V-shaped slot 22 formed from a material 21 top edge 21*a*, to a location between arm openings or sleeves 23. The patient's arms are fitted through the sleeves 23, and the material 21 is wrapped around patient 11, as shown in FIGS. 4 and 7. Alternatively, the patient can fit their arms through sleeves 23, donning the gown 20 as they would put on a coat, with the material 21 then wrapped, as shown in FIGS. 5 and 6, with the direction of which wrapping is shown at arrow A in FIG. 8. In FIG. 8 the material 21 edge 24*a* is shown to be approximately aligned with a bottom 22*a* of V-shaped slot 22, and with the other edge 24*b* extending therefrom to be wrapped over edge 24*a*, as illustrated by arrow A. So arranged, a section 25*b* of Velcro type fastening material, that can be a hook or mat section, is secured to a top portion of edge 24*b*, at a junction with a material 21 sloping section 29. So arranged, the section 25*b* is aligned for pressing onto, to couple with, an opposite hook or mat section 26*b* of the Velcro type fastening material that is to couple with section 25*b*. The fastener section 26*b*, as shown, is preferably secured onto an inner area of material 21, spaced back from a sloping edge 30. The sloping edges 29 and 30 are held together, as illustrated in FIG. 5, and, as shown in FIG. 8, and the edge 24*b* of material 21 can then be wrapped, as shown by arrow A, around the patient. Thereat, another Velcro type fastener section 25*a*, that is secured at a junction of a top of edge 24*b* with sloping edge 30, aligned with and is coupled to still another section of a Velcro type fastener 26*a* that is secured to an outer surface of material 21. The gown 20 is thereby secured to cover over the body of patient 11, as shown in FIG. 5, which FIG. 5 shows the patient as having donned the grown 20 and wrapped it from their left to right, with the fastener section 25*a*, shown in broken lines, coupling below their right arm in FIG. 4. Though, of course, the gown 20 and its fasteners could be arranged to allow the gown to be wrapped from right to left and secured, within the scope of this disclosure. Whereas, with the gown 20 fitted to patient 11 as shown in FIG. 4, the gown is wrapped around their back from their right to left, with the edge 24*b* to be coupled by fastener section 25*a*, shown in broken lines located below their left arm in FIG. 5.

In FIG. 6 the patient 11 is shown seated with the gown 20 worn as shown in FIG. 5, and with the gown sloping edges 29 and 30 shown as having been spread apart, as by releasing the coupling at fastener sections 25*b* and 26*b*. The sloping edges are then pulled away from each other, opening the gown, to allow a medical person 27 to listen, using a stethoscope 28 place on their chest, to their heart or lungs. With, in FIG. 7, the gown 20 is worn as shown in FIG. 4. Which patient is shown seated, with the gown sloping edges 29 and 30 having been spread apart, after releasing the coupling at fastener sections 25*b* and 26*b*, The gown 20 is thereby open to allow the medical person 27 to listen, using stethoscope 28 placed on the patient's back, to their heart or lungs. Such gown 20 opening, as shown in FIGS. 6 and 7, does not require a release of fastener sections 25*a* and 26*a*, leaving the patient's body essentially covered except in those areas where a medical person needs to have access for the performance of a medical procedure.

In a number of medical procedures as performed on a patient in either a doctor's office or hospital, it is often desirable to have access to the patient's arms, legs and sides. To provide such access, without a sacrifice to the patient's dignity, the gown 20 preferably includes slits 35 , is shown, the slits 35 that are formed along the patient's sleeves, from the sleeve end to shoulder area, and are closeable as with Velcro type fasteners 36, shown in broken lines, or the like. Similarly, slits 37 are provided up the gown sides that are also closeable with Velcro types fasteners 38, or the like, as shown in broken lines. So arranged, the gown 20 of the invention can be opened at a location where a medical procedure is to be performed without a sacrifice to the patient's modesty and comfort and that open area can then be conveniently and securely closed back when the procedure is concluded. Further, while Velcro type fasteners are shown herein as preferred for maintaining the gown 20 wrapped around the patient 11, and for closing the described slits 35 and 37, it should be understood that other fasteners such as snaps, ties, buttons, or the like, can be so used within the scope of the invention.

As shown in FIGS. 4 through 8, the gown 20 of the invention is preferably manufactured to cover the patient's body to both preserve their modesty, for comfort and, with an appropriate selection of fabric for use in the gown manufacture, to provide a garment that will keep the patient comfortably warm. Further, such material can be one selected for its attractive appearance, such one having a pleasing pattern or print, to provide a gown that is aesthetically and psychologically pleasing to lift the patient's spirits.

While a preferred embodiment of the present invention in a medical patient gown has been shown and described herein, it should be understood the disclosure is made by way of example only and that variations and modifications thereto are possible, within the scope of this disclosure, without departing from the subject matter coming within the scope of the following claims and reasonable equivalency thereof, which claims I regard as my invention.

I claim:

1. A medical patient gown comprising, a section of a soft flexible fabric material that is cut to be wrapped around a medical patient and to extend from their shoulders to at or near their knee area and includes arm sleeves and with a V-shaped notch formed in said section from material top edge into a back area, which said notch is equidistant from said arm sleeves, and said section of material has parallel vertical first and second side edges, with said first side edge spaced a first distance from a first of said sleeves and said second side edge spaced a second distance from the other or second said sleeve, and said second distance is greater than said first distance to allow said second side edge to be pulled across said first side edge to an area of said section of material that is below said first sleeve; and a first coupling means for releasably connecting said second side edge onto said section of material below said first sleeve.

2. The medical patient gown as recited in claim 1, further including a second coupling for releasably connecting a top of said section of material first side edge to an inner surface of said section of material back from said section of material second side edge.

3. The medical patient gown as recited in claim 2, wherein the first and second couplings are each a pad of a hook material to releasably couple into the surface of the section of material.

4. The medical patient gown as recited in claim 3, further including, for each pad of hook material, a pad of a mat material for receiving and connecting onto the section of material surface to receive hooks of said pad of hook material, with individual hooks of said hook material hooking so as to bind therein.

5. The medical patient gown as recited in claim 4, wherein the pad of hook material and pad of mat material constitute a Velcro type fastener.

6. The medical patient gown as recited in claim 4, wherein the pad of mat material is the fabric material from which the gown is manufactured.

7. The medical patient gown as recited in claim 1, wherein sloping sides extend from top ends of the first and second side edges to a gown collar area.

8. The medical patient gown as recited in claim 1, further including a sleeve slit formed in each sleeve from a lower edge thereof into the gown shoulder area; and including at least one releasable fastener means for maintaining each said sleeve slit in a closed attitude.

9. The medical patient gown as recited in claim 1, further including a side slit formed in each gown side extending from a lower gown edge upwardly towards the sleeve and ending in the gown central area; and a plurality of releasable fasteners are arranged in spaced relationship across from one another along each said side slit.

* * * * *